US008006853B2

(12) United States Patent
Delage

(10) Patent No.: US 8,006,853 B2
(45) Date of Patent: Aug. 30, 2011

(54) CLOSURE CAP AND A RECEPTACLE FITTED THEREWITH

(75) Inventor: Jean-François Delage, Clamart (FR)

(73) Assignee: L'oreal, Paris (FR)

( * ) Notice: Subject to any disclaimer, the term of this patent is extended or adjusted under 35 U.S.C. 154(b) by 1484 days.

(21) Appl. No.: 11/429,163

(22) Filed: May 8, 2006

(65) Prior Publication Data

US 2006/0273062 A1 Dec. 7, 2006

Related U.S. Application Data

(60) Provisional application No. 60/690,886, filed on Jun. 16, 2005.

(30) Foreign Application Priority Data

May 9, 2005 (FR) ..... 05 04619

(51) Int. Cl.
*B65D 39/00* (2006.01)
*B65D 51/04* (2006.01)
*B65D 47/00* (2006.01)

(52) U.S. Cl. ..... 215/237; 215/235; 220/254.5; 220/254.7; 220/839; 222/563; 222/556

(58) Field of Classification Search ..... 215/295, 215/201, 216, 237, 235; 220/254.3, 839, 220/263, 264, 254.7; 222/563, 556, 153.01, 222/153.14, 153.09, 562; 264/268, 239
See application file for complete search history.

(56) References Cited

U.S. PATENT DOCUMENTS

| | | | | |
|---|---|---|---|---|
| 3,015,403 | A * | 1/1962 | Fuller | 222/563 |
| 3,059,816 | A | 10/1962 | Goldstein | |
| 4,209,100 | A | 6/1980 | Uhlig | |
| 4,782,964 | A | 11/1988 | Poore et al. | |
| 5,497,906 | A | 3/1996 | Dubach | |
| 5,573,127 | A | 11/1996 | Takahashi et al. | |
| 5,735,419 | A | 4/1998 | Ma | |
| 5,868,265 | A | 2/1999 | Kobayashi | |
| 6,779,689 | B2 * | 8/2004 | Flaig et al. | 222/182 |
| 6,834,769 | B2 | 12/2004 | Takahashi et al. | |
| 7,717,281 | B2 * | 5/2010 | Baudin | 215/235 |
| 2002/0148802 | A1 | 10/2002 | Takahashi et al. | |
| 2005/0173366 | A1 | 8/2005 | Baudin | |

FOREIGN PATENT DOCUMENTS

| | | |
|---|---|---|
| DE | GM 78 23 284 | 12/1979 |
| EP | 0 547 978 A1 | 6/1993 |
| EP | 0 699 591 A2 | 3/1996 |

(Continued)

OTHER PUBLICATIONS

Jean-Francois Delage, "Closure Cap and a Receptacle Fitted Therewith," U.S. Appl. No. 11/706,374, filed Feb. 15, 2007.

(Continued)

*Primary Examiner* — Robin Hylton
(74) *Attorney, Agent, or Firm* — Oliff & Berridge, PLC

(57) ABSTRACT

A closure cap may include: a base portion that is provided with at least one dispenser orifice, and that is configured to be fastened onto a receptacle body; a lid that pivots relative to the base portion; and an opening control element configured to control opening of the lid. The opening control element may include a skirt that surrounds at least a portion of the base portion, and that is connected to the base portion via at least one elastically-deformable connection element.

36 Claims, 15 Drawing Sheets

FOREIGN PATENT DOCUMENTS

| | | | |
|---|---|---|---|
| EP | 1 281 628 | A2 | 7/2002 |
| FR | 2 685 294 | | 6/1993 |
| FR | 2 771 386 | A1 | 5/1999 |
| GB | 2 166 123 | A | 4/1986 |
| JP | A 64-066355 | | 3/1989 |
| JP | U 01-66355 | | 4/1989 |

OTHER PUBLICATIONS

Office Action from related U.S. Appl. No. 11/706,374, mailed Aug. 19, 2010.

* cited by examiner

Fig.17
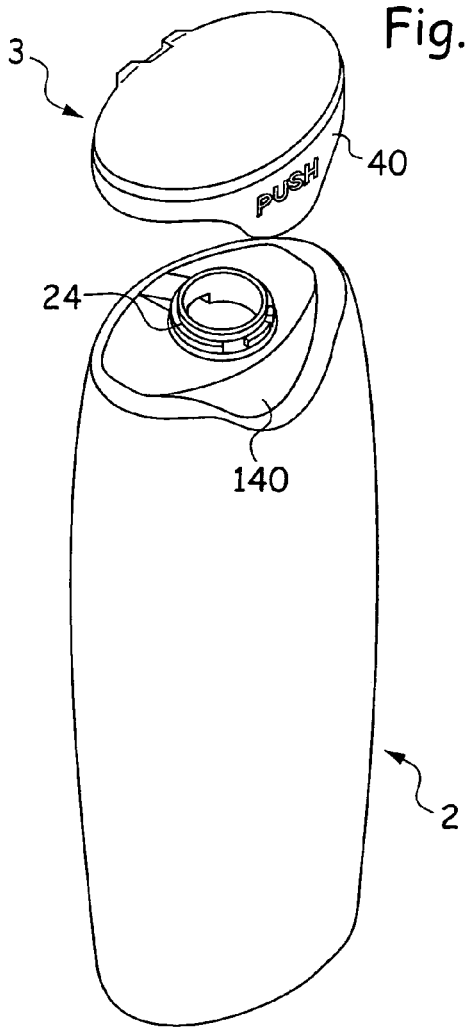
Fig.19
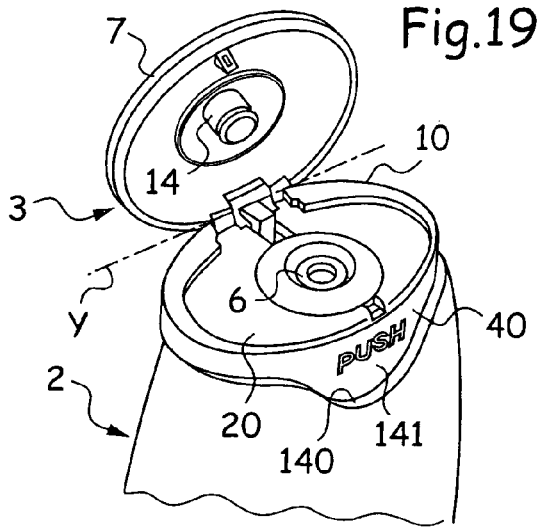
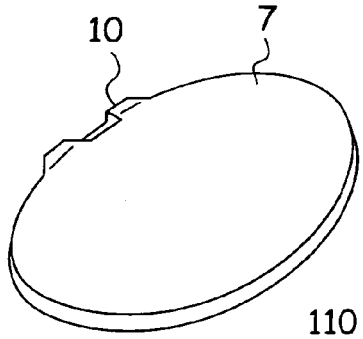
Fig.20
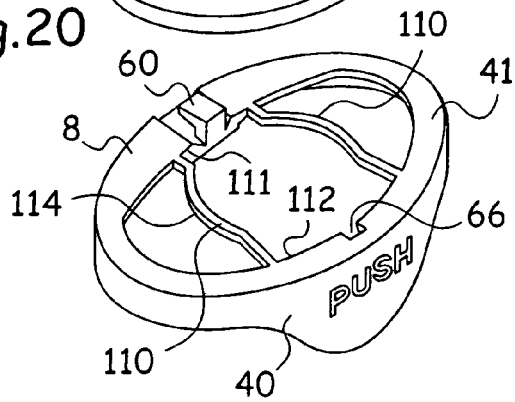
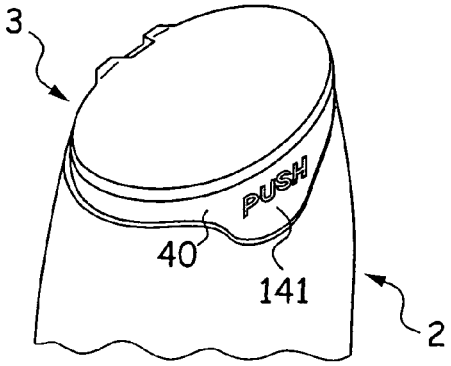
Fig.18

Fig.29
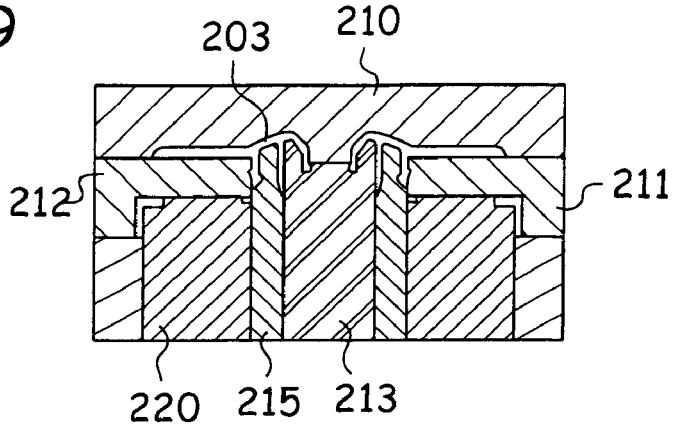
Fig.31
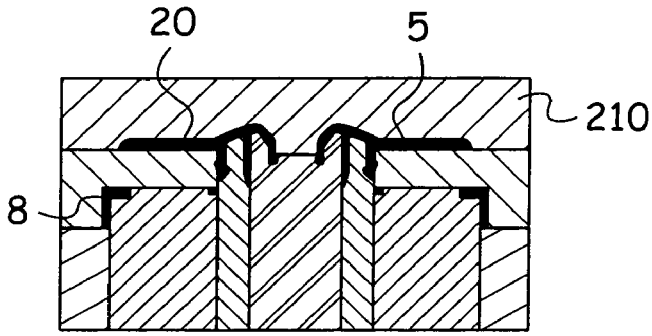
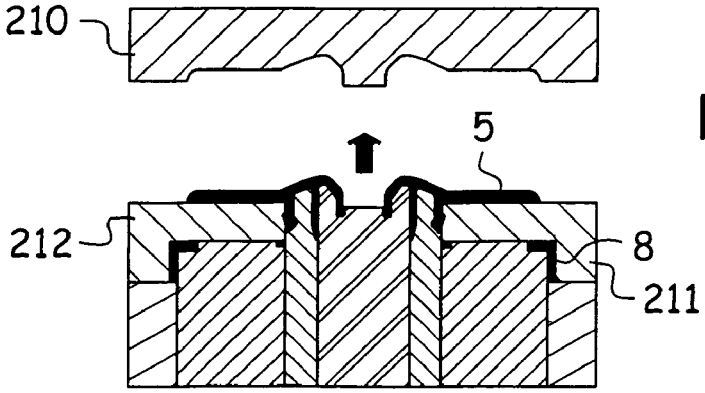
Fig.33

Fig.35
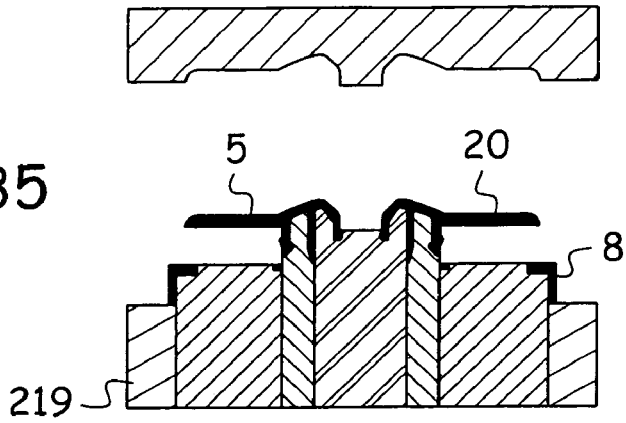
Fig.37
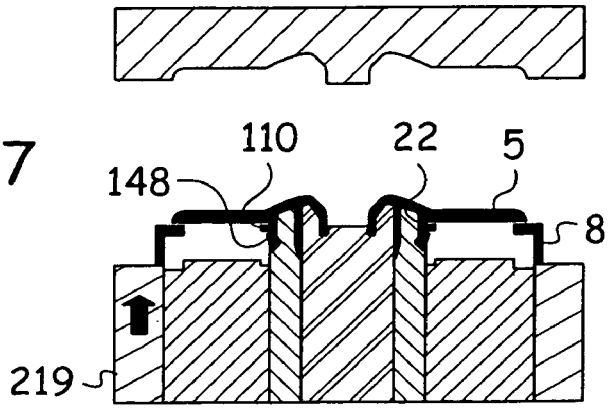
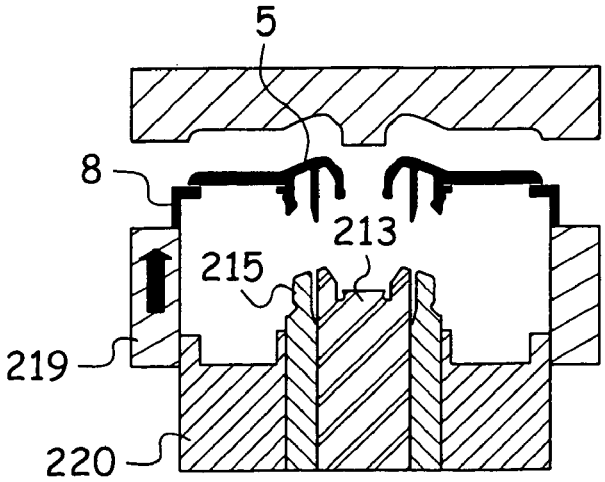
Fig.39

Fig.40
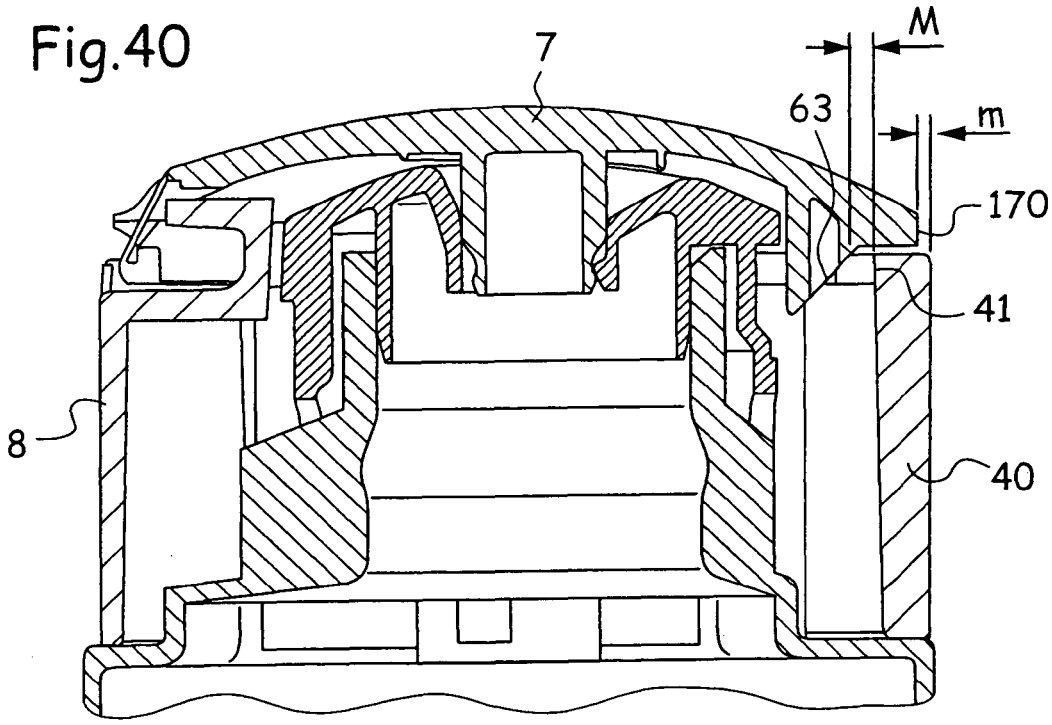
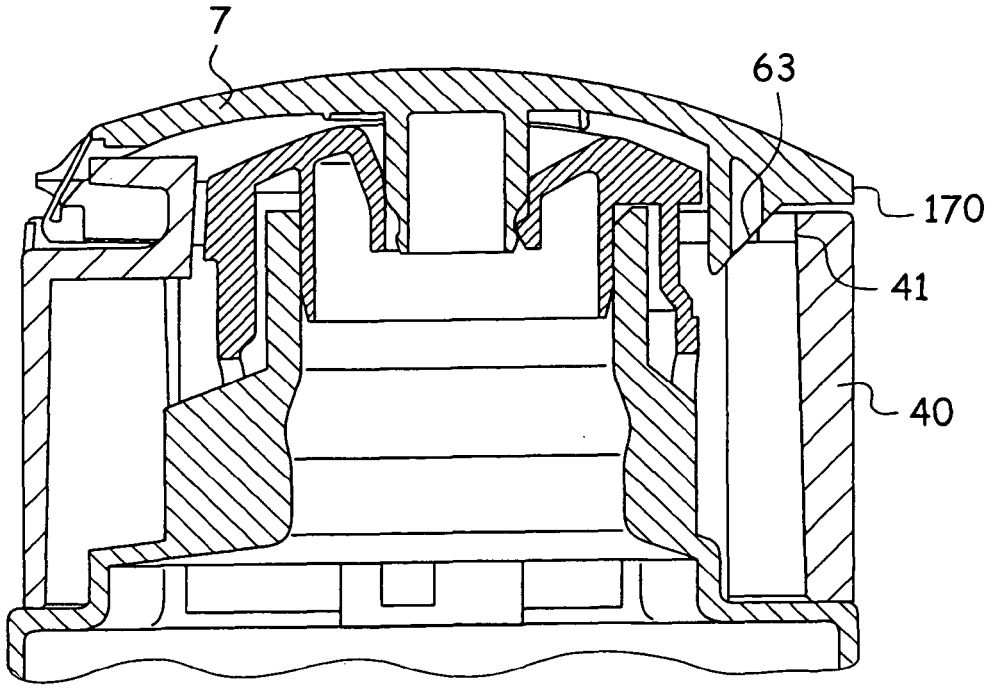
Fig.41

CLOSURE CAP AND A RECEPTACLE FITTED THEREWITH

This non-provisional application claims priority from French patent application No. 05 04619 filed on May 9, 2005, and claims priority from U.S. provisional application No. 60/690,886 filed on Jun. 16, 2005.

The present invention relates to receptacles fitted with closure caps each comprising a base portion provided with at least one dispenser orifice, and a lid that pivots relative to the base portion, the cap further comprising an opening control element for controlling opening of the lid.

BACKGROUND

Japanese patent application JP 1-66355 discloses a closure cap including a base portion including an internally-threaded skirt for screwing onto the neck of the receptacle, and that is surrounded by an outer covering skirt. A lid is hinged onto the base portion by means of a hinge including a spring-forming tongue that assists the opening movement of the lid. An opening control element can slide over the base portion in order to act on the lid and on the hinge.

Such a cap is not completely satisfactory, in particular from an appearance point of view, since, at rest, when the lid is closed, the opening control element projects forwards by a non-negligible amount.

European patent application EP 0 699 591 discloses a cap including an outer covering skirt that is interrupted on the side remote from the hinge, so as to receive the opening control element which comprises a presser hinged onto the base portion and a presser member that is suitable for sliding in a recess of the base portion. The presser member comprises ramps for co-operating with portions in relief of the lid so as to cause said lid to rise, and an end for acting on the spring-forming tongue of the hinge. The presser member includes an oblong cutout in which a dispenser endpiece is engaged. Such a cutout is likely to encourage the accumulation of dirt, as is the recess in which the presser member slides.

French patent application FR 2 685 294 discloses a closure cap that functions in a fairly similar way, and that is likely to present the same drawbacks.

U.S. Pat. No. 6,834,769 describes a receptacle including a closure cap in which the opening control element slides inside the base portion. On the side remote from the hinge, the opening control element includes a projecting portion on which the user must press in order to open the lid. The opening control element must be made in the form of a separate part, thereby increasing the cost of manufacture. In addition, the user is provided with an area on which to press that is relatively small, thereby decreasing comfort in use.

European patent application EP 1 281 628 describes a closure cap that is made in a similar way.

SUMMARY

A need exists to benefit from a closure cap that can be made easily by molding a plastics material, that is attractive, easy to use, and that reduces the risk of dirt accumulating.

In one of its aspects, the invention provides a closure cap comprising a base portion that is provided with at least one dispenser orifice, and that is for fastening onto a receptacle body, a pivoting lid, and an opening control element for controlling opening of the lid, in which cap the opening control element comprises a skirt that surrounds at least a portion of the base portion, and that is connected to said base portion via at least one elastically-deformable connection element.

The skirt of the opening control element may act as a presser, so as to enable the user to control opening, while concealing the top portion of the receptacle body onto which the cap is mounted. The skirt may provide the user with a relatively large presser surface, thereby increasing comfort in use.

In an embodiment of the invention, the elastically-deformable connection element(s) may act as resilient return means for returning the skirt into its initial position after it has been actuated by the user.

Finally, the cap may be made in such a manner as to reduce the risk of dirt accumulating, e.g. as a result of the absence of a cutout surrounding the outside of the dispenser orifice, and as a result of it being possible for there to be no external recess, similar to prior art recesses, for guiding the opening control element.

In an embodiment of the invention, the entire cap is molded as a single part as a result of the presence of the elastically-deformable connection element(s). The deformable connection element(s) enable(s) the various portions of the cap to be disposed in a configuration that makes them easy to mold, and said element(s) can then deform while the cap is being mounted on the receptacle body, so as to take up their final configuration.

In another embodiment of the invention, the opening control element is not made integrally with the base portion.

The opening control element and the base portion can be made separately, and then assembled. The base portion and the opening control element can be made in a single mold, in such a manner as to enable them to be assembled together while the cap is being unmolded.

In an embodiment of the invention, the cap includes two elastically-deformable connection elements connecting the presser-forming skirt to the base portion.

By way of example, the elastically-deformable connection elements may be connected at one end to the skirt of the opening control element, and at the other end to a portion of the base portion serving to mount said base portion on a neck of the receptacle.

By way of example, each of the deformable connection elements may be in the form of an arm presenting a shape that is not rectilinear, in particular that is undulating.

In a variant embodiment, the elastically-deformable connection elements may come into contact with the base portion, while being in sliding contact therewith, when the user presses on the opening control element.

Each of the connection elements may be connected at two opposite ends to respective portions of the opening control element. The connection elements may comprise two curved portions having concave sides that face each other, the curved portions being configured to be engaged on the base portion when the opening control element is at rest.

When the user presses on said opening control element, the connection elements may deform elastically in contact with the base portion, thereby ensuring that the control element returns to its initial position when it is released by the user.

The skirt of the opening control element may present any shape, preferably adapted to the shape of the top portion of the receptacle body, and it may present a circular or oblong cross-section, for example.

On the face on which the user presses, the skirt may present an extension that extends downwards, and that is engaged in a correspondingly-shaped recess of the receptacle body.

In an embodiment of the invention, the elastically-deformable connection elements may be connected to the skirt of the opening control element at locations that are situated substantially opposite each other in a plane that is parallel to the pivot axis of the lid, and they may also be connected to the base portion at locations that are substantially opposite each other in said plane.

The opening control element may include at least one portion in relief that is arranged to co-operate with the receptacle body in such a manner that the receptacle body guides the opening control element in displacement, at least in part, while said opening control element is being actuated by the user.

In particular, the top wall of the receptacle body may present a shoulder shape defining at least one guide surface, and better two opposite guide surfaces, along which the opening control element can be displaced.

In an embodiment in which the receptacle body presents, in cross-section, an oblong shape that is elongate along a major axis, the two above-mentioned guide surfaces may be formed on either side of the neck, being oriented in a direction that is substantially perpendicular to the major axis.

The neck of the receptacle may include at least one portion in relief for angularly positioning the base portion of the cap relative to the body of the receptacle. By way of example, the portion in relief may be in the form of a spline that extends, at least in part, along the neck, e.g. substantially symmetrically relative to a mid-plane that is perpendicular to the pivot axis of the lid. By way of example, the base portion of the cap may include at least one notch in which the above-mentioned spline can be engaged while the base portion is being mounted on the receptacle body.

The base portion may be fastened onto the receptacle body by snap-fastening, in an embodiment of the invention. On its inside surface, the base portion may include at least one portion in relief for snap-fastening on a corresponding portion in relief formed on the neck in the proximity of its base, for example.

The base portion may include an annular sealing lip for bearing against the inside surface of the neck.

The skirt of the opening control element may be extended, in particular at its top portion, by an inwardly-directed rim.

In an embodiment of the invention, the connection elements may be connected at their ends to the rim, and extend substantially in a common plane, for example.

In an embodiment of the invention, the base portion includes a plate that comes to cover the rim, at least in part, when the closure cap is in place on the receptacle.

In an embodiment of the invention, while the cap is being manufactured, the plate and the rim may be molded spaced apart from each other, e.g. by a distance that is not less than 4 millimeters (mm), thereby making it possible to improve the strength of the mold, or even by a distance that is not less than 5 mm, as a result of the presence of the deformable connection element(s), and said deformable connection element(s) then enable(s) the plate to move axially relative to the opening control element while said cap is being fastened onto the receptacle body. Once the closure cap is in place on the receptacle body, the clearance between the plate and the rim need only be in the range 0.2 mm to 0.5 mm, so as to hold the skirt in place axially, while enabling it to be displaced towards the hinge when the user exerts pressure thereon.

In the molding configuration, the elastically-deformable connection element(s) are, for example, in the form of arms having an undulating shape, as indicated above, and the arms may, for example, extend along a plane that is substantially perpendicular to the axis of the portion of the base portion that is used for mounting on the receptacle. While the closure cap is being put into place on the receptacle, the arms may deform, and they may extend obliquely towards the body of the receptacle once the base portion has been fastened onto the neck.

In a variant not shown, the deformable connection elements are rectilinear. In this event, during molding, the clearance between the plate and the rim is smaller, e.g. being selected as a function of the elasticity module of the material from which the connection elements are molded.

In another embodiment of the invention, the connection elements are molded in such a manner as to be capable of being brought to snap-fasten on the base portion while the cap is being unmolded.

The lid may be molded with the base portion or it may be fitted thereon.

In an embodiment in which the base portion and the opening control element are molded as a single part, the lid may be molded with the base portion or it may be fitted on the base portion and fastened thereon, e.g. by snap-fastening.

In an embodiment in which the control element is assembled with the base portion, e.g. during unmolding, the lid may be molded integrally with the base portion.

The hinge connecting together the lid and the base portion may advantageously include at least one spring-forming tongue that assists the opening movement of the lid. The tongue may be bent, and it may pass through a maximum stress state when the lid is in an intermediate position between the closed position and the open position.

The opening control element may advantageously be arranged to act on the spring-forming tongue, when actuated by the user, so as to push said tongue to the point of triggering the spring effect.

On the hinge side, the opening control element may include a tab for pressing on the spring-forming tongue. The tab may present a bracket shape, so as to make it possible to press on the spring-forming tongue at a location that is higher than the pivot axis of the lid.

The opening control element may also advantageously be arranged to act directly on the lid, when actuated by the user, so as to make it easier to disengage a closure pin, carried by the lid, of the dispenser orifice of the base portion.

In an embodiment of the invention, the opening control element may thus be arranged to act on a portion in relief that is carried by the lid in a region of said lid that is situated substantially remote from the hinge. By way of example, the lid may include a tooth on its bottom face in the proximity of its edge remote from the hinge, and the plate of the base portion may include an opening enabling the tooth to co-operate with the opening control element when the user presses on said opening control element, so as to displace it towards the hinge. By way of example, the above-mentioned rim of the opening control element may include a notch in which the tooth of the lid is engaged, and the bottom wall of the notch may come to bear against a sloping face of the tooth when the opening control element is first displaced, so as to cause the lid to start pivoting.

In the closed position and when the opening control element is at rest, the lid may be arranged in such a manner as to extend set back from the opening control element on the side remote from the hinge, or, in contrast, it may project in front of the opening control element.

In order to reduce the risk of uncontrolled opening, the opening control element may be configured in such a manner as to be capable of being displaced through a non-zero stroke before acting on the lid. This makes it possible for the edge of the lid to project in front of the opening control element before said opening control element starts to act on the lid.

The dispenser orifice may be defined by an annular surface that is extended downwards by at least one elastically-deformable tab that is arranged to snap-fasten on a closure pin carried by the lid. By way of example, the annular surface may be extended by a plurality of tabs that are arranged to snap-fasten on the closure pin other than on the side remote from the face of the control element on which the user presses in order to cause the lid to open. This makes it possible for the lid to open without being hindered too much.

The invention also provides a receptacle comprising a body and, fastened onto the body, a closure cap as defined above. The receptacle body may be arranged to present a shouldered top wall, so as to guide the opening control element in displacement.

In another of its aspects, the invention also provides a receptacle comprising a closure cap, and a body onto which the closure cap is fastened, the closure cap comprising a base portion that is fastened onto the body, a lid that is capable of pivoting relative to the base portion, and an opening control element that is movable relative to the base portion, so as to act on the lid and cause it to open. The receptacle body may advantageously be arranged to guide the opening control element in displacement.

This makes it possible to avoid having to provide a recess on the base portion serving to guide the opening control element. This also makes it possible to connect the opening control element to the base portion via at least one deformable connection element, where appropriate, e.g. a deformable connection element as defined above. The base portion of the cap may include a plate, and the opening control element may be held axially on the receptacle body by means of said plate, while nevertheless having the possibility of sliding in order to act on the lid. The closure cap can thus be made more easily.

In another of its aspects, the invention also provides a closure cap comprising:

- a base portion including a portion serving to fasten it onto the neck of a receptacle;
- an opening control element that is snap-fastened on the fastener portion, and that is capable of sliding relative to said fastener portion; and
- a lid that is hinged onto the base portion, the opening control element being arranged to act on the lid, so as to drive it, at least in part, towards the open position.

In another of its aspects, the invention also provides a method of manufacturing a receptacle, the method comprising the following steps:

- molding a closure cap as a single part, the closure cap comprising a base portion for fastening onto a receptacle body, a lid that is hinged relative to the base portion, and an opening control element for controlling opening of the lid, and comprising a skirt that is connected to the base portion via at least one connection element, the base portion including a plate through which at least one dispenser orifice passes, the plate being molded with a non-zero gap between the skirt and the plate, e.g. not less than 4 mm, or even not less than 5 mm; and
- placing the closure cap on the receptacle body, e.g. in such a manner as to position the skirt substantially in line with a side wall of the receptacle body, and exerting pressure on the base portion, so as to fasten said base portion on the receptacle body, the connection elements deforming while the base portion is being fastened onto the receptacle body, and the plate moving closer to the skirt of the opening control element.

Before or after the closure cap has been mounted, the receptacle may be filled with a fluid or a powder, e.g. a cosmetic, or a care product.

In another of its aspects, and independently or in combination with the above, the invention also provides a method of manufacturing an article comprising first and second assembled-together parts, and in which:

- the two parts are molded in a single mold that is provided with at least one extraction pusher, the second part being disposed in the mold relative to the first, in such a manner that, during unmolding, displacement of the extraction pusher is accompanied by displacement of the second part relative to the first, and by the parts being fastened together, e.g. snap-fastened.

By way of example, the first part is the base portion of the above-defined closure cap, and the second part is the opening control element.

The first part may be molded in a first material, and the second part in a second material that is different from the first, e.g. of different color.

The base portion may be molded integrally with the lid.

At least one slider may be provided in the mold, defining, at least in part, the cavities that are used to mold the two parts. The slider may be displaced, so as to enable the extraction pusher to act.

Independently or in combination with the above, the invention also provides a closure cap comprising:

- a lid provided with a closure pin; and
- a base portion onto which the lid is hinged, the base portion including a dispenser orifice that is arranged to be closed by the closure pin when the lid is closed, the dispenser orifice being defined, at least in part, by an annular surface against which the pin bears in leaktight manner in the closed position, said surface being extended downwards by a fastener portion that is arranged to snap-fasten on a corresponding portion in relief of the closure pin.

The above-mentioned surface may be extended by one or more elastically-deformable tabs that are arranged to snap-fasten in an annular groove formed in the closure pin.

The surface need not have an extension that co-operates with the closure pin on the side remote from the face of the opening control element on which the user presses in order to open the lid. Thus, opening the lid is not hindered by the pin catching on the base portion, which catching effect would tend to get worse the more the user presses.

The invention can be better understood on reading the following detailed description of non-limiting embodiments thereof, and on examining the accompanying drawings, in which:

FIG. 17 is an exploded perspective view of a receptacle constituting another embodiment of the invention;

FIG. 18 shows the closure cap in place on the receptacle body, the closure cap being in its closed position;

FIG. 19 is a view similar to FIG. 18, the closure cap being in its open position;

FIG. 20 is a perspective view from above showing the opening control element and the lid in isolation;

FIGS. 28 to 39 show the method of manufacturing the closure cap of FIGS. 17 to 27;

FIGS. 40 to 42 are diagrammatic and fragmentary sections showing a variant embodiment;

Figure 1:
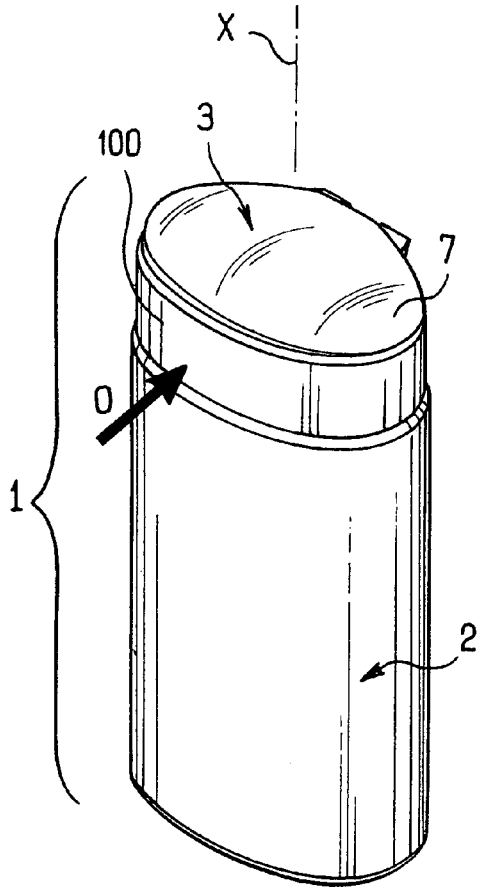
FIG. 1 is a perspective view showing a receptacle made in accordance with the invention, the closure cap being closed.
Figure 2:
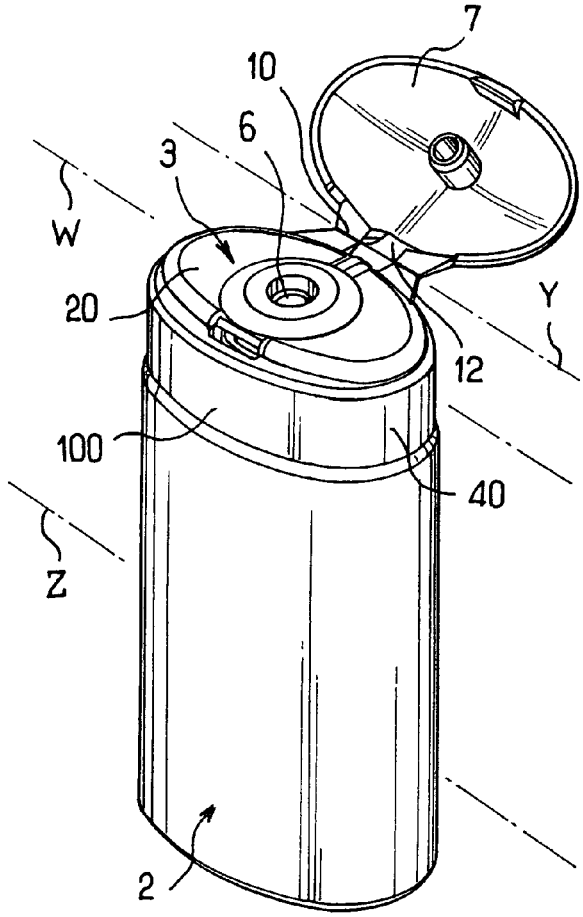
FIG. 2 is a view showing the FIG. 1 receptacle, the closure cap being open.
Figure 3:
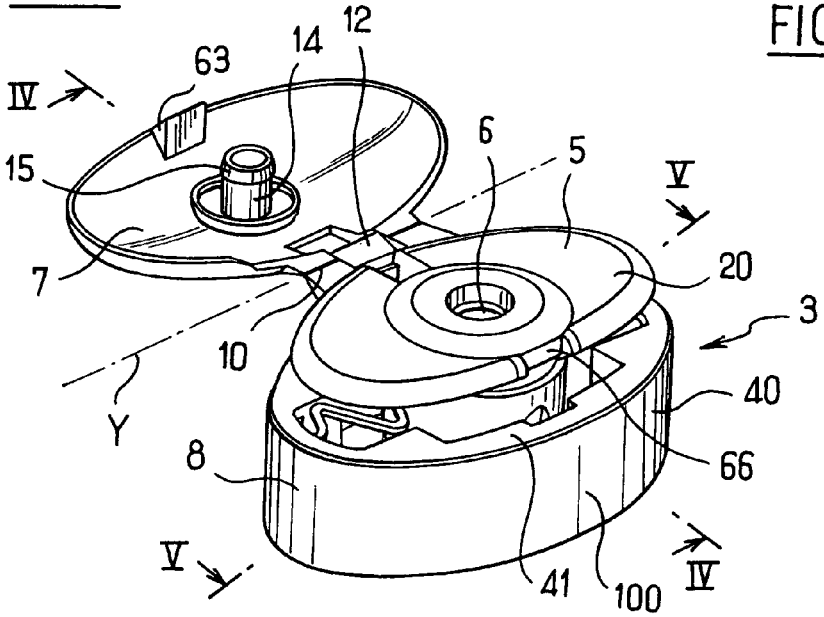
FIG. 3 is a perspective view showing the closure cap in isolation, before being mounted on the receptacle body.
Figure 4:
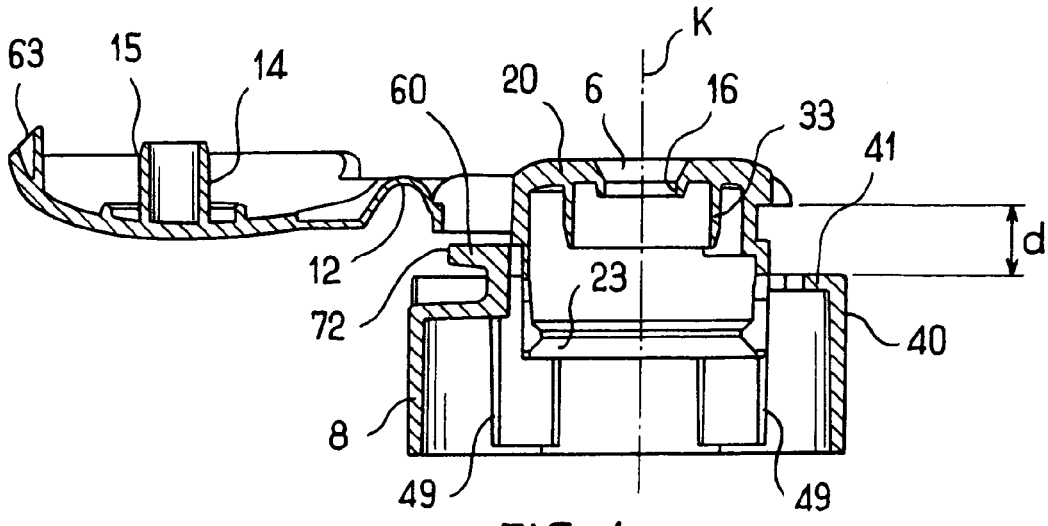
FIGS. 4 and 5 are two diagrammatic sections of the FIG. 3 cap on IV-IV and V-V respectively of FIG. 3.
Figure 5:
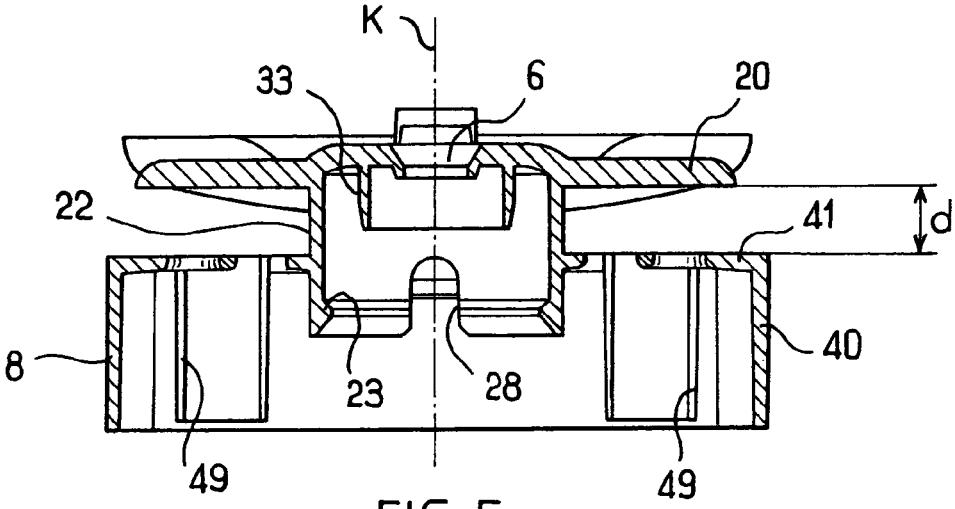
Figure 6:
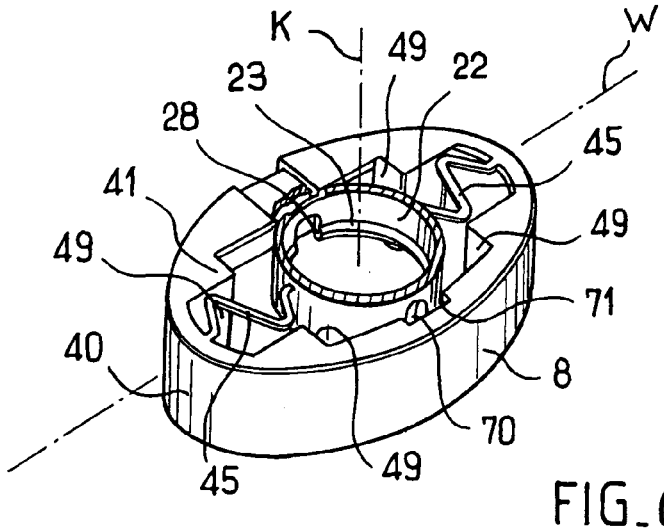
FIG. 6 is a diagrammatic cross-section of the closure cap below the plate of the base portion.

The receptacle 1, shown in FIGS. 1 and 2, comprises a body 2 onto which there is fastened a closure cap 3.

In the embodiment under consideration, the receptacle 1 presents an elongate shape along a longitudinal axis X, and the body 2 presents, in cross-section, an oblong shape that is elongate along a major axis Z.

The closure cap 3, shown in isolation in FIGS. 3 to 6, comprises a base portion 5 provided with a dispenser orifice 6, a lid 7 that is hinged onto the base portion 5 about an axis Y that is substantially parallel to the major axis Z, and an opening control element 8 that is movable relative to the base portion in a direction that is generally perpendicular to the hinge axis Y.

The lid 7 is connected to the base portion by a film hinge 10 comprising two portions that are disposed on either side of a spring-forming tongue 12, sometimes referred to as a toggle, passing through a maximum stress state in an intermediate position between the closed position and the open position, in such a manner as to assist the opening movement of the lid 7 and ensure that, once open, said lid maintains its position.

The lid 7 includes a pin 14 for closing the orifice 6, said pin being provided with at least one portion in relief 15 that is configured to snap-fasten on the bottom edge 16 of the orifice 6 when the lid 7 is completely closed.

Figure 7:
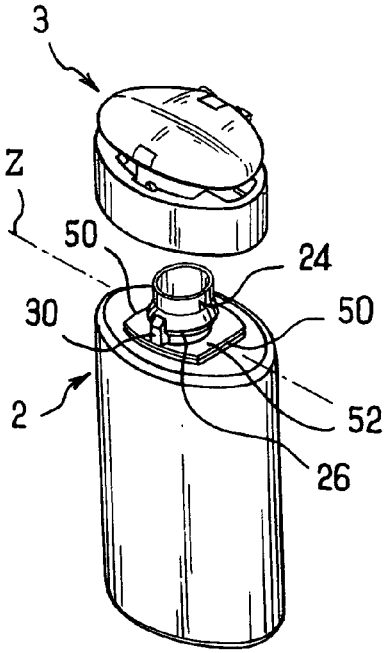
FIG. 7 is a perspective view showing the closure cap being mounted on the receptacle.

The base portion 5 includes firstly a plate 20 that is elongate along a major axis W, and on the top face of which the orifice 6 opens out, and secondly a portion 22 that extends below the plate 20, and that is used for fastening onto a neck 24 of the receptacle, visible in FIG. 7.

In the embodiment under consideration, the portion 22 is in the form of a tubular mounting skirt of axis K, that is provided, at the bottom of its inside face, with an annular flange 23 for snap-fastening on a corresponding flange 26 of the neck 24. In the embodiment under consideration, the portion 22 further includes two notches 28 that are arranged to receive splines 30 of the neck 24, in such a manner that the major axis W of the plate 20 is substantially parallel to the major axis Z of the body 2.

An annular sealing lip 33 for bearing against the inside surface of the neck 24 is connected to the bottom face of the plate 20.

The opening control element 8 includes a tubular skirt 40 that extends around the entire neck 24, and that, in the embodiment under consideration, presents a cross-sectional shape that is substantially geometrically similar to the shape of the body 2, as can be seen in FIGS. 1 and 2.

The skirt 40 is extended at its top portion by an inwardly-directed rim 41. The rim 41 is covered in part by the plate 20 when the cap 3 is fastened onto the neck of the receptacle 2, as can be seen in FIG. 2.

In the embodiment under consideration, the skirt 40 of the opening control element 8 is connected to the portion 22 of the base portion 5 by means of two elastically deformable arms 45, each presenting substantially the shape of one period of a sinewave. The arms 45 join the skirt 40 and the portion 22 at locations that are situated substantially in a plane containing the major axis W of the cap 3. When said cap is molded, the arms 45 extend substantially level with the rim 41, perpendicularly to the axis K of the portion 22. The distance d between the plate 20 and the rim 41 is thus about 5 mm, for example, thereby making it easier to make the cap by molding a thermoplastic material, e.g. a polyolefin.

Figure 10:
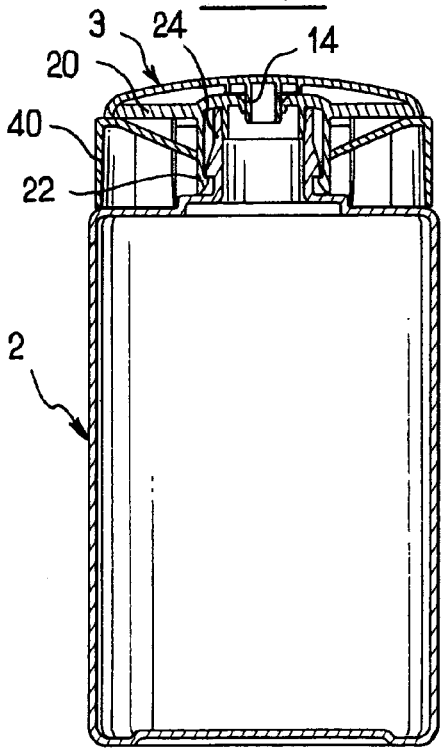
FIGS. 10 and 11 are views similar to FIGS. 8 and 9 after the closure cap has been fastened onto the neck of the receptacle.

While the cap is being mounted on the receptacle body, the arms 45 can deform obliquely downwards, so as to enable the portion 22 to snap-fasten on the neck 24, as shown in FIG. 10.

The opening control element 8 includes uprights 49 that extend substantially parallel to the axis K on either side of the portion 22, and that co-operate with guide surfaces 50 formed by shoulders of the transverse top wall 52 of the body 2, onto which the bottom of the neck 24 is connected. The guide surfaces 50 are oriented substantially perpendicularly to the major axis Z of the receptacle. The co-operation between the uprights 49 and the surfaces 50, by means of said uprights 49 bearing against said surfaces, ensures that the skirt 40 is guided in translation along a direction that is perpendicular to the major axis W.

Figure 8:
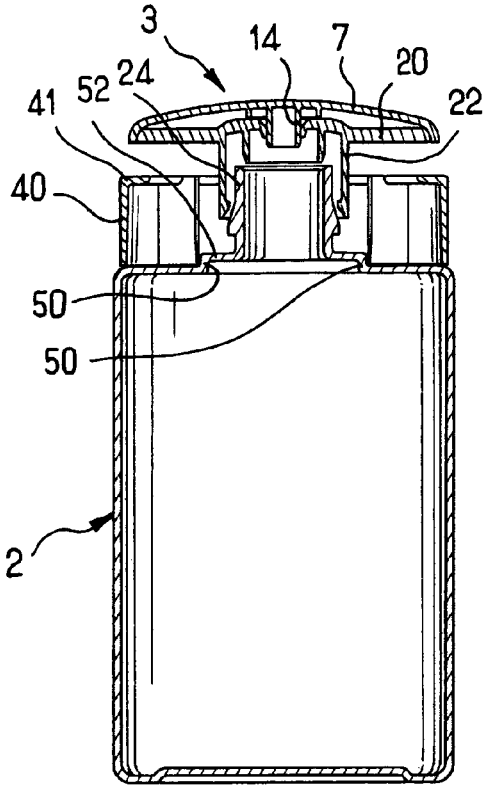
FIGS. 8 and 9 are diagrammatic longitudinal sections in planes that are respectively parallel and perpendicular to the major axis of the cross-section of the receptacle, prior to the closure cap being mounted in permanent manner on the body of the receptacle.
Figure 9:
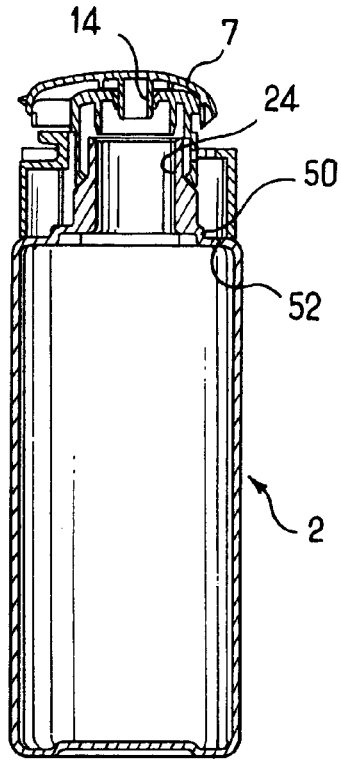

While the closure cap 3 is being mounted on the receptacle body 2 with the lid 7 folded down on the plate 20, the skirt 40 firstly comes to bear against the top transverse wall 52 of the receptacle, at the periphery of said wall, as can be seen in FIGS. 8 and 9.

Figure 11:
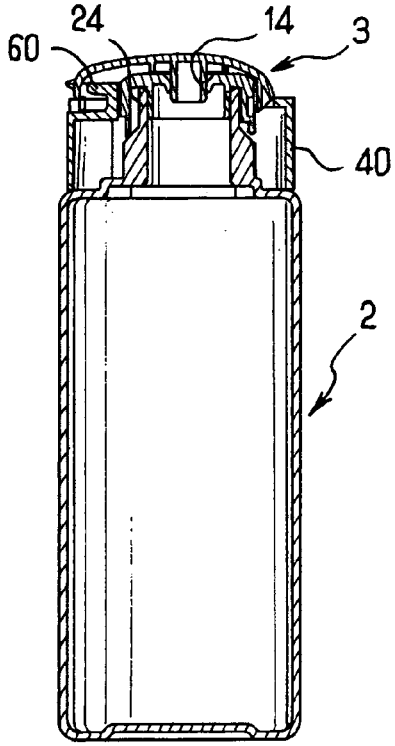

When pressure is exerted on the lid 7 towards the body 2, the plate 20 moves closer to the rim 41, and the portion 22 becomes fastened by snap-fastening on the neck 24, as can be seen in FIGS. 10 and 11. The final clearance between the plate 20 and the rim 41 lies in the range 0.2 mm to 0.5 mm, for example.

On the side remote from the surface 100 on which the user presses in order to control opening, the opening control element 8 includes a tab 60 for acting on the spring-forming tongue 12, so as to push said tongue to its trigger point, thereby causing the lid to open.

Figure 12:
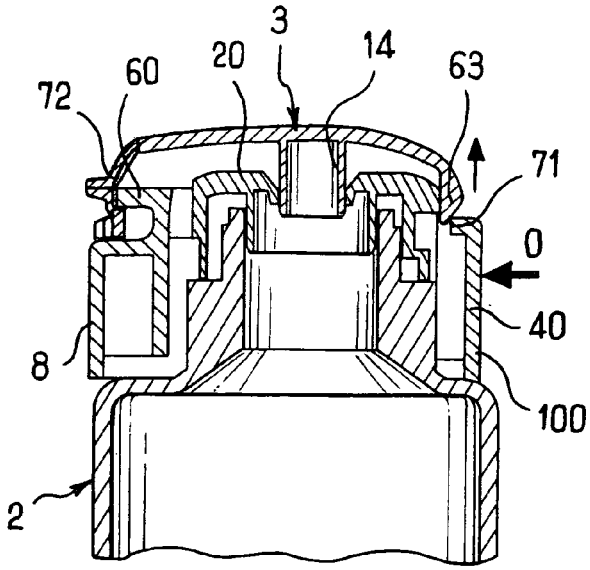
FIGS. 12 to 14 are fragmentary longitudinal sections showing the operation of the opening control element.
Figure 13:
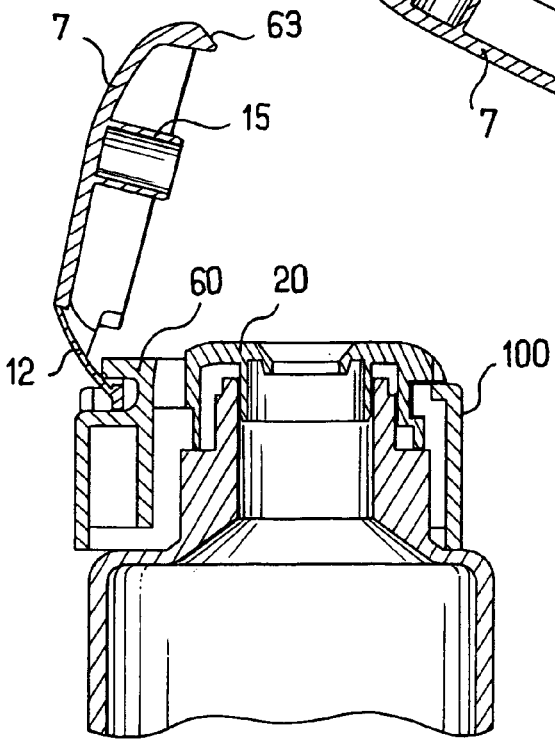

The opening control element 8 is also arranged to act on a portion in relief 63 of the lid 7, so as to cause the lid to start rising, and in particular cause the closure pin 14 to disengage, as shown in FIG. 12.

In the embodiment under consideration, the portion in relief 63 is in the form of a tooth formed in the proximity of the edge of the lid that is remote from the hinge 10.

On its edge remote from the hinge 10, the plate 20 includes an opening 66 through which the tooth 63 passes. The rim 41 includes a notch 70 having a bottom wall 71 that can come to bear against a sloping face of the tooth 63, in such a manner as to cause the lid to rise while the skirt 40 is being displaced, as can be seen in FIG. 12.

In the embodiment shown, the tab 60 presents a bracket shape, and its free end 72 is situated just above the pivot axis Y of the lid when the closure cap 3 is in place on the receptacle.

When the user presses on the opening control member 8 in the direction of arrow O, the bracket-shaped tab 60 presses, via its end 72, on the spring-forming tongue 12 until said tongue passes through its maximum stress state, the opening movement of the lid being completed by the energy that has accumulated in the spring-forming tongue 12 being restored.

Figure 14:
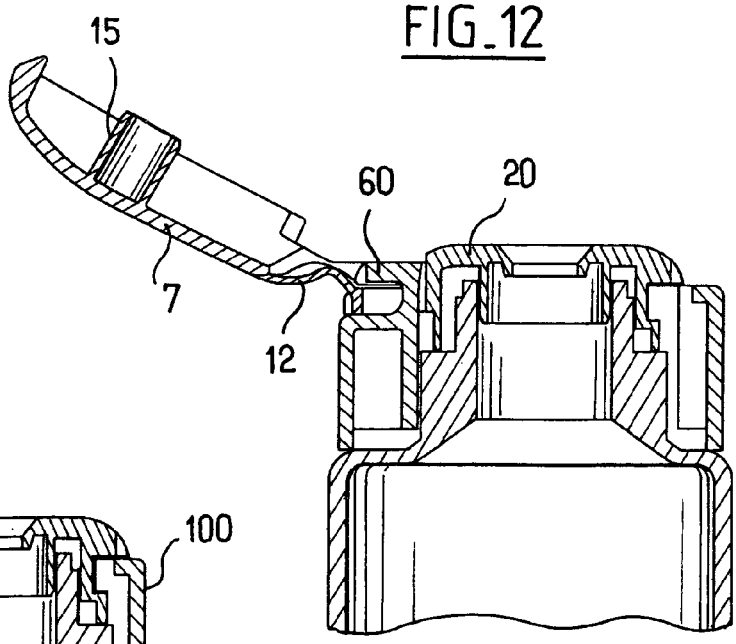

While the opening control member 8 is being displaced in order to open the lid, the arms 45 deform elastically. Once the user stops pressing on the skirt 40 and releases said skirt, the arms 45 can return it substantially into its initial position, as shown in FIG. 14.

Figure 15:
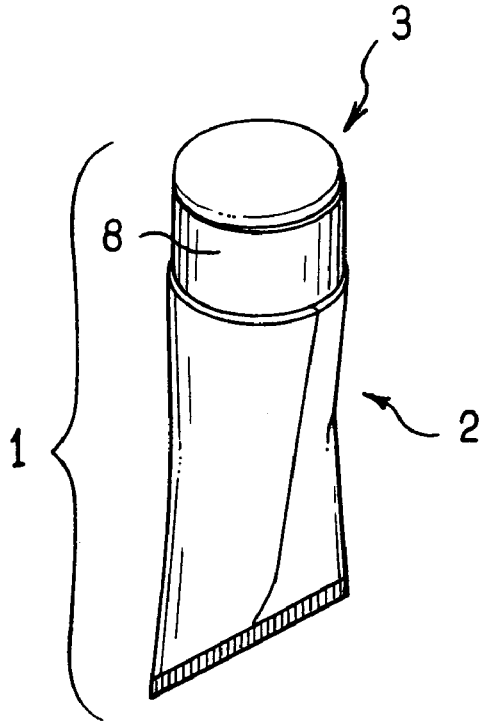
FIGS. 15 and 16 are perspective views showing another example of a receptacle made in accordance with the invention, the closure cap being shown closed and open respectively.
Figure 16:
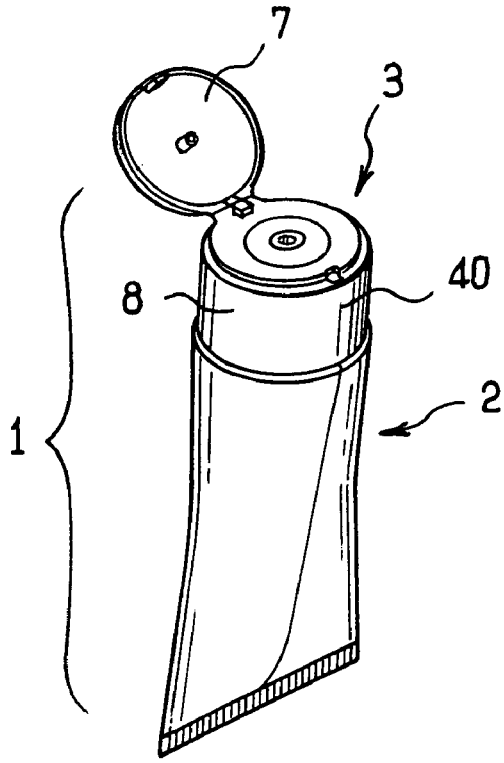
Figure 21:
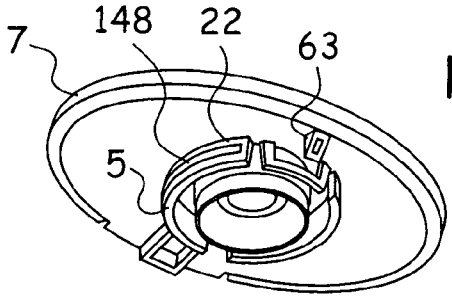
FIG. 21 is a perspective view from below showing the lid and the base portion in isolation.

FIGS. 15 and 16 show a receptacle 1 comprising a closure cap 3, and a body 2 that is in the form of flexible tube. It this embodiment, the top portion of the body 2 presents a substantially circular cross-section, and the skirt 40 also presents a substantially circular cross-section.

A variant embodiment of the receptacle is described below with reference to FIGS. 17 to 27.

This embodiment differs from the embodiment of FIGS. 1 to 14 in particular by the way in which the opening control element 8 is connected to the base portion 5.

Figure 22:
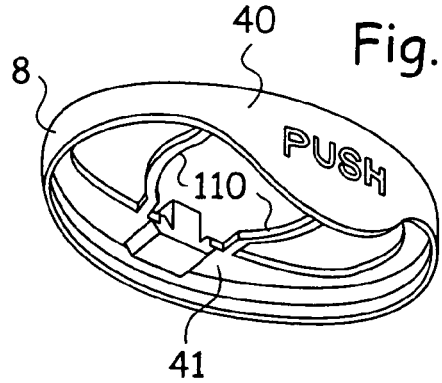
FIG. 22 is a perspective view from below showing the opening control element in isolation.
Figure 24:
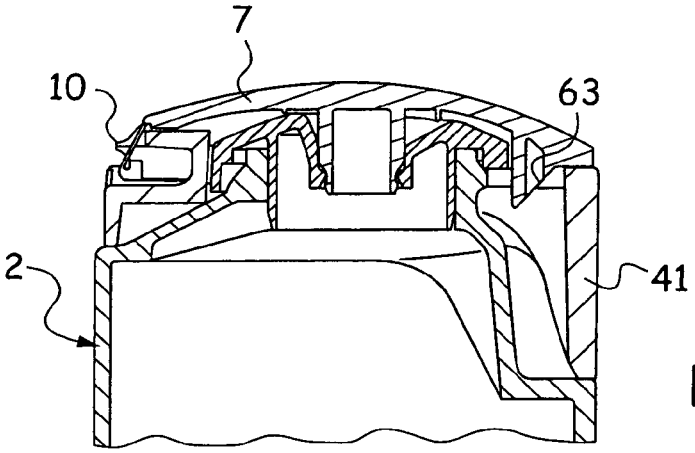
FIG. 24 is a diagrammatic and fragmentary longitudinal section of the receptacle in a section plane that is perpendicular to the FIG. 23 section plane.

The above-described arms 45 are replaced by arms 110, each extending between two opposite regions 111 and 112 of the inside edge of the rim 41, as can be seen in FIGS. 20 and 22 in particular. While the user is not exerting any pressure on the opening control element, each arm 110 presents a curved portion 114 that is adapted to match substantially the shape of the portion 22 of the base portion that is used for fastening said base portion on the neck 24 of the receptacle. In the embodiment under consideration, the portion 22 includes a mounting skirt that is arranged to snap-fasten onto the neck 24.

The curved portions 114 are connected to the edge 111 via portions 120 that are parallel to each other, and that are both perpendicular to the major axis W. The curved portions 114 are connected to the edge 112 via rectilinear portions 122 that diverge a little towards the edge 112.

Figure 23:
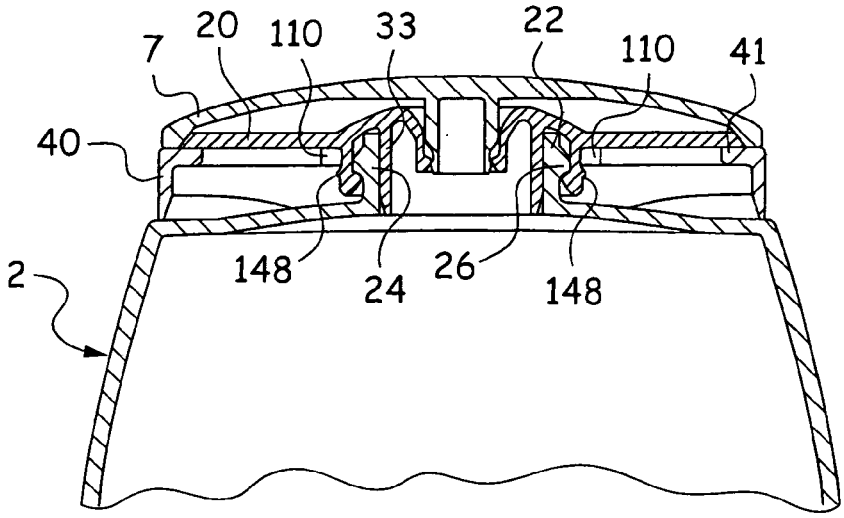
FIG. 23 is a diagrammatic and fragmentary longitudinal section of the receptacle, the closure cap being closed.
Figure 25:
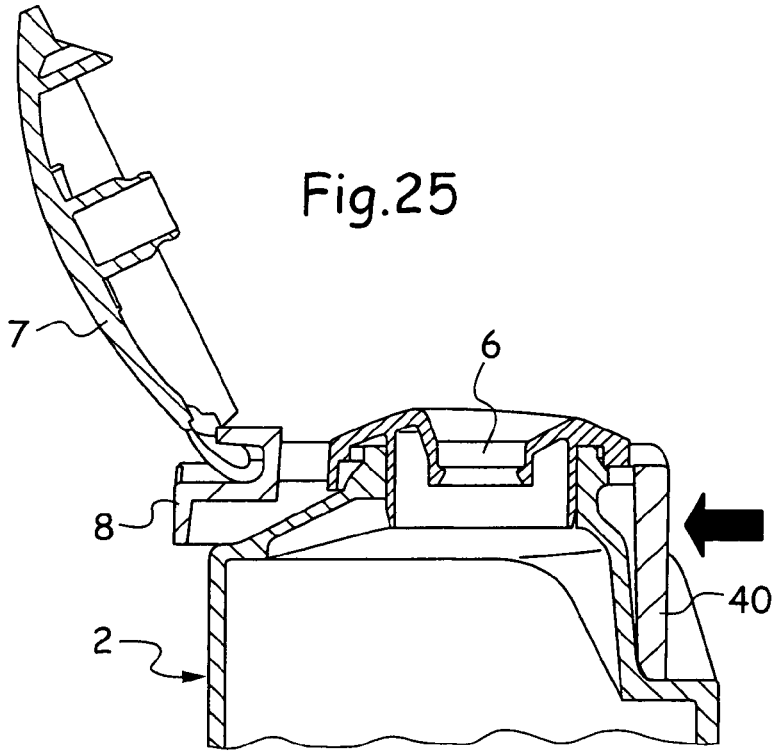
FIG. 25 is a view similar to FIG. 24, the closure cap being open.

When the opening control element 8 is in place on the base portion 5, the arms 110 are snap-fastened between the plate 20 and portions in relief 148 carried by the portion 22, as can be seen in FIG. 23 in particular.

Figure 27:
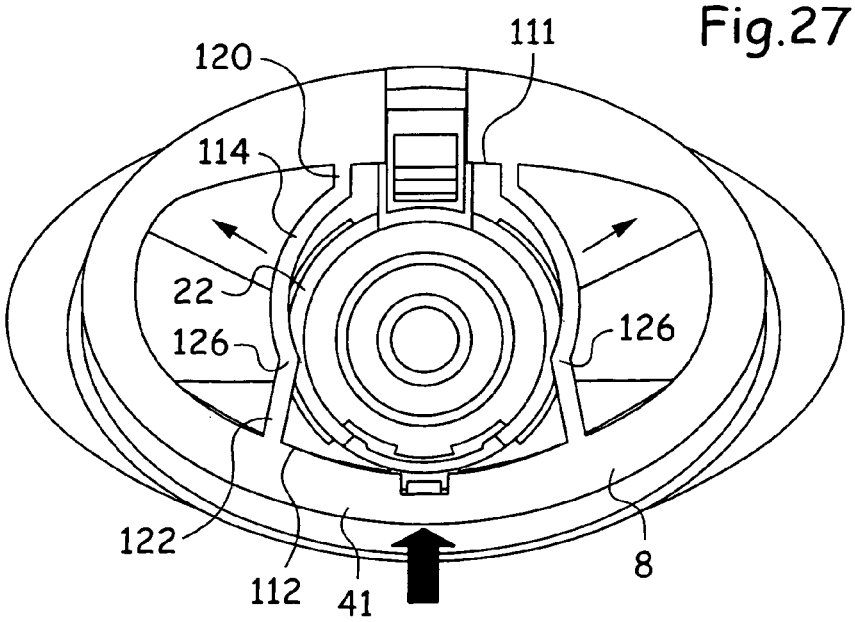
Figure 28:
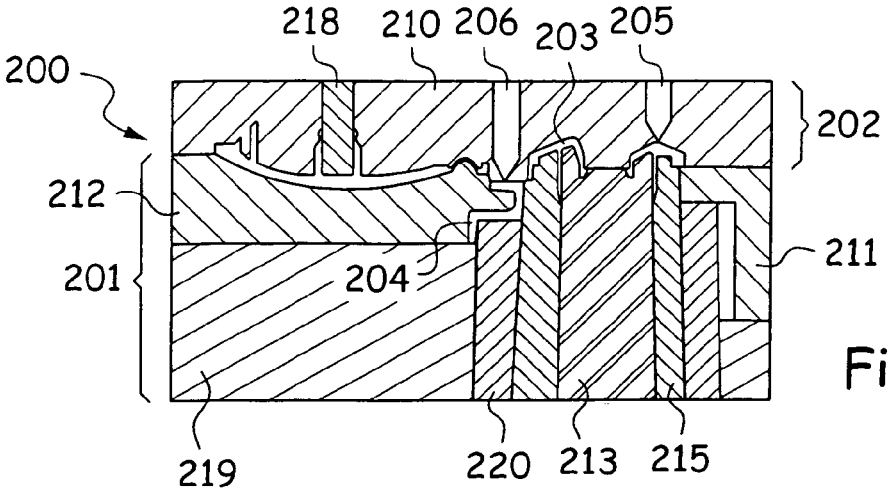

When the user presses on the skirt 40 in order to cause the lid to open, the arms 110 deform elastically, as shown in FIG. 27. At the end of the displacement of the skirt 40, each bend 126, formed at the junction between the curved and rectilinear portions 114 and 122, remains on the same side of the half plane containing the axis of the dispenser orifice 6 and the major axis W, such that when the user releases the opening control element 8, the arms 110 tend to return said opening control element into its initial position, shown in FIG. 26.

The body 2 of the receptacle can include a recess 140, as shown in FIG. 17, and the skirt 40 can present, on the side where the user presses, an extension 141 that matches the shape of the recess 140, as shown in FIGS. 18 and 19.

The closure cap 3 can be manufactured in a single mold, as described below with reference to FIGS. 28 to 39.

The mold 200 that is used comprises a first portion 201 and a second portion 202 that define a first cavity 203 for molding the base portion and the lid, and a second cavity 204, that does not need to be in communication with the cavity 203, for molding the opening control element 8.

In the embodiment under consideration, the material is injected into the cavities 203 and 204 via respective injection channels 205 and 206.

The cavity 203 is defined between firstly parts 210 and 218 belonging to the second portion 202 of the mold, and secondly lateral sliders 211 and 212 and parts 213 and 215 belonging to the first portion 201 of the mold.

The cavity 204 is defined between firstly the part 210, and secondly the part 215, the sliders 211 and 212, a part 220, and an extraction pusher 219.

Once the mold has been closed, the cavities 203 and 204 can be filled.

This can be done using the same thermoplastic material with different colors and/or using chemically different materials.

Figure 30:
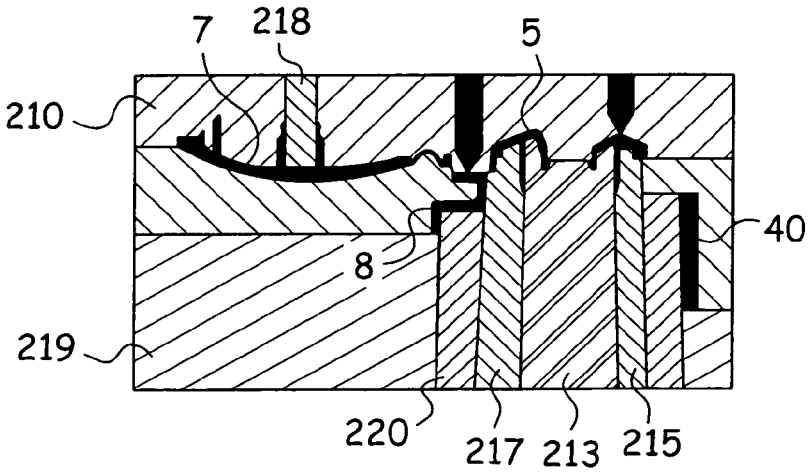

Injection into the cavities 204 and 203 can take place simultaneously, as shown in FIG. 30.

Figure 32:
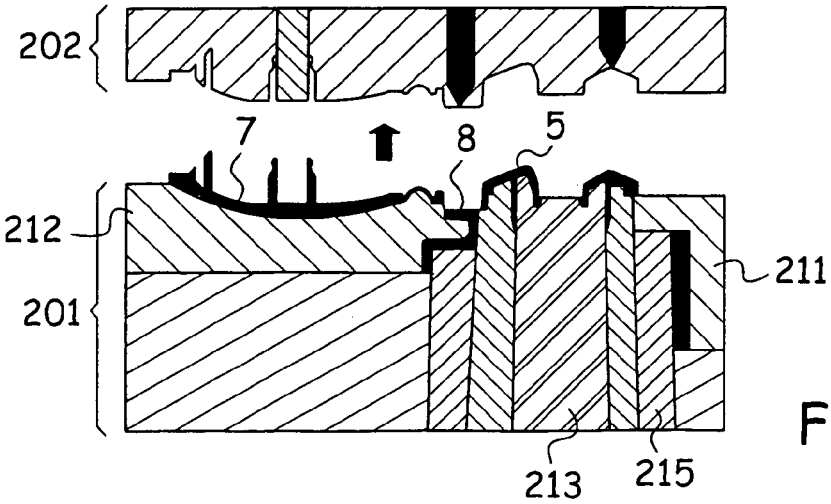
Figure 34:
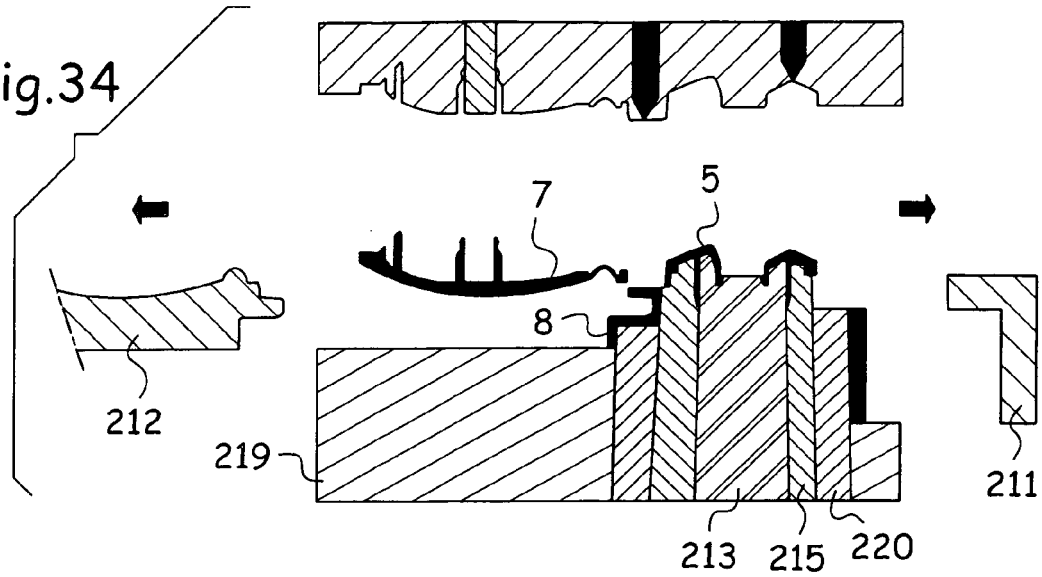

After injection, the second portion of the mold 202 is separated from the first, as shown in FIGS. 32 and 33. The sliders 211 and 212 can be removed, as shown in FIG. 34.

Figure 36:
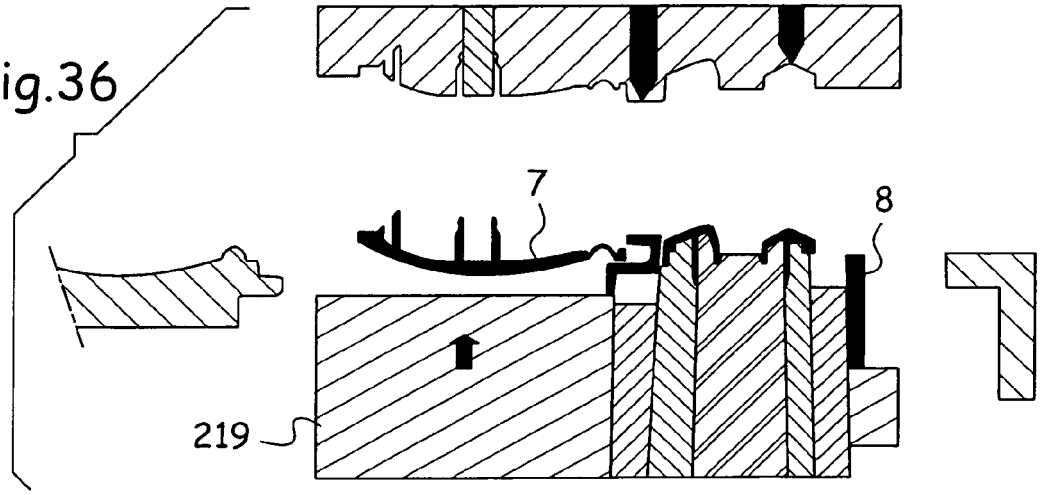

Then, as shown in FIGS. 36 and 37, the pusher 219 can be raised, so as to cause the arms 110 to snap-fasten behind the teeth 148 of the portion 22 of the base portion 5.

Figure 38:
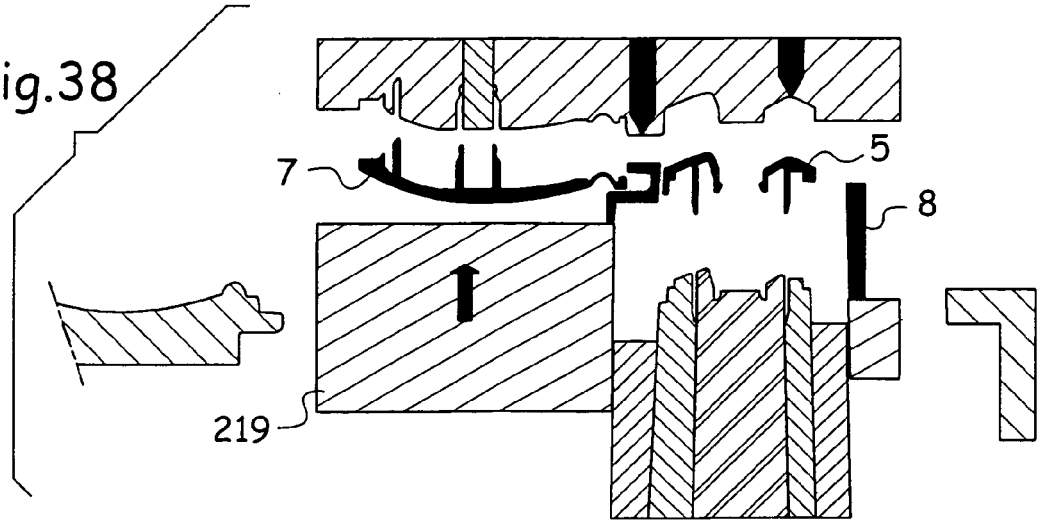

The closure cap can then be completely extracted by extending the upwards stroke of the pusher 219, as shown in FIGS. 38 and 39.

Regardless of how the opening control element 8 is connected to the base portion 5, the skirt 40 of the opening control element 8 can, as shown in FIG. 40, be made in such a manner that its depression stroke before the tooth 63 comes to bear against the edge of the rim 41 takes place over a distance M that is greater than the distance m over which the skirt 40 might project forwards relative to the free edge 170 of the lid 7.

Figure 42:
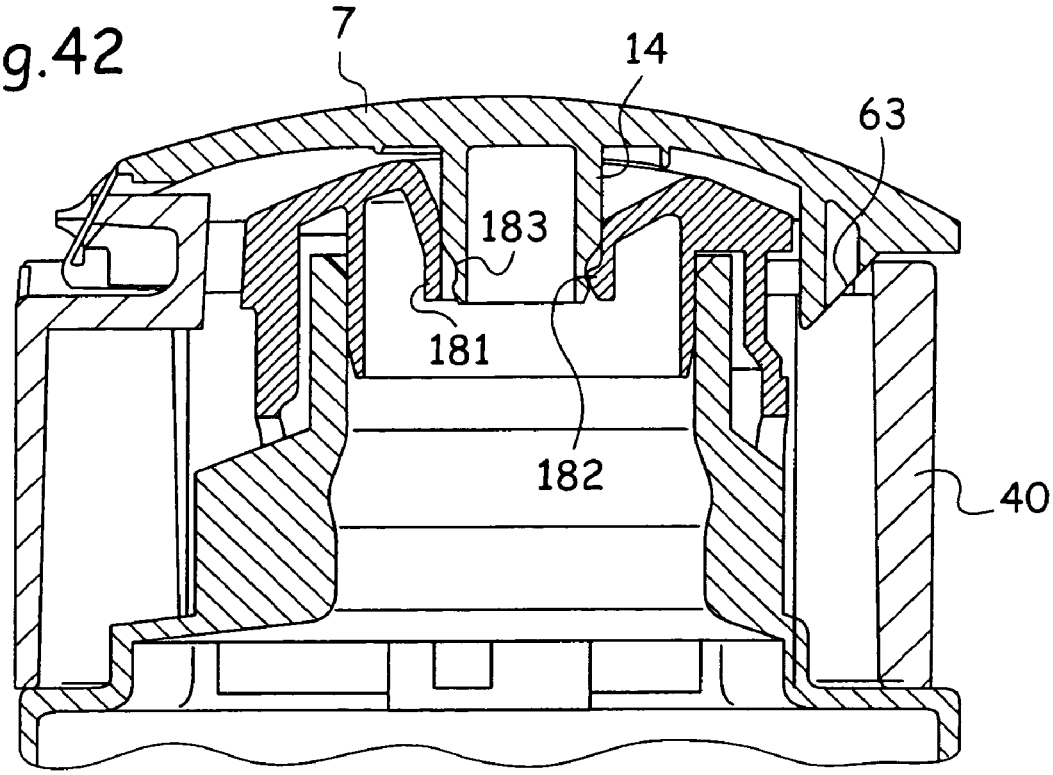

The edge 170 can thus impede the skirt 40 being pressed in accidentally while the receptacle is being transported for example, by coming into register with the skirt 40 before said skirt bears, via the rim 41, against the tooth 63, as shown in FIGS. 41 and 42.

Figure 44:
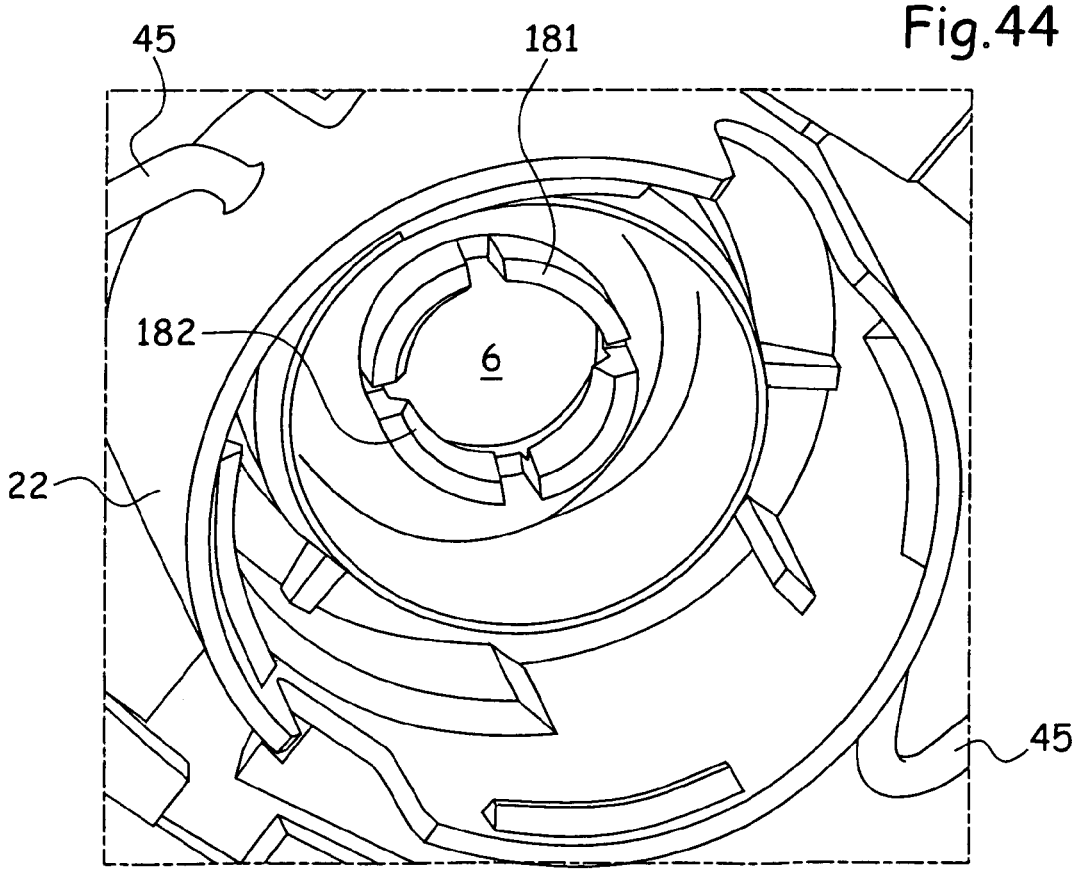
FIG. 44 is a diagrammatic perspective view from below of the base portion.
Figure 26:
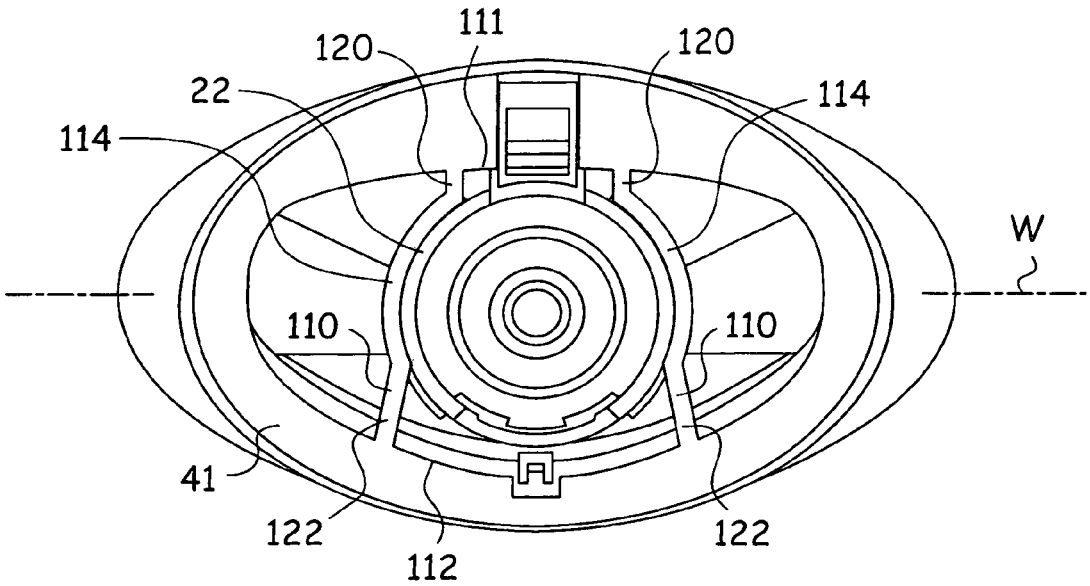
FIGS. 26 and 27 show the deformation of the arms of the opening control element when the user presses on the opening control element.
Figure 43:
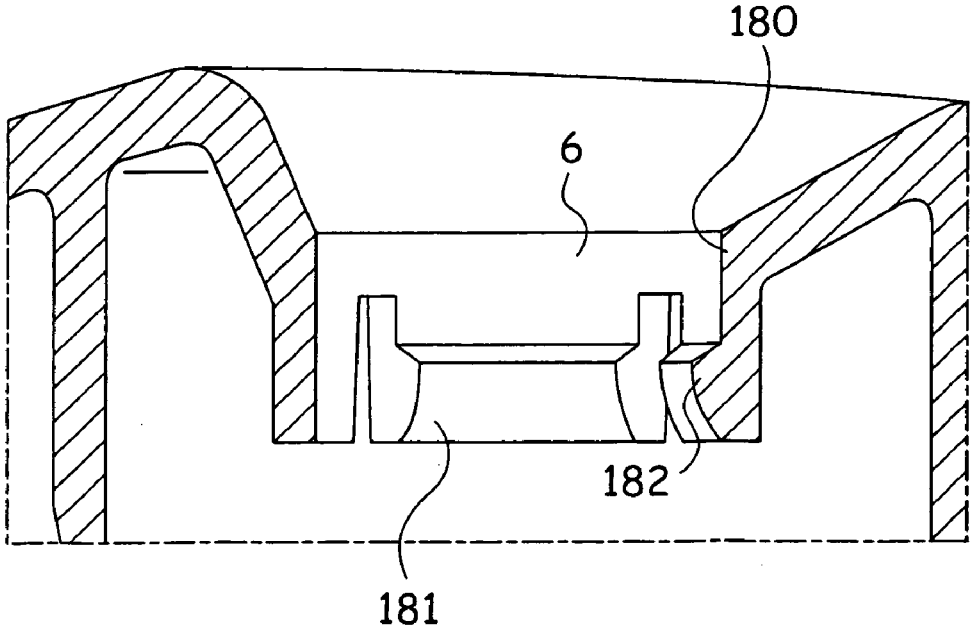
FIG. 43 shows a detail of FIG. 41.

Also, in another aspect of the invention, the dispenser orifice 6 can be defined by an annular surface 180, e.g. cylindrical, that is extended downwards by tabs 181 that are suitable for including teeth 182 for snap-fastening in a corresponding groove 183 of the closure pin 14, as shown in FIGS. 42 to 44.

On the hinge side of the lid, the surface 180 need not be extended by a tab 181 provided with a tooth 182, so as to make it easier to open the lid.

The closure pin and the dispenser orifice can be made in accordance with the teaching of U.S. patent application Ser. No. 2005/0173366.

The cap can be fastened onto the neck other than by snap-fastening, e.g. by clamping.

The receptacle body and the opening control member can also co-operate in some other way, with portions in relief other than the shoulders being formed on the top transverse wall of the receptacle.

Although the present invention is described above with reference to particular embodiments, it should be understood that those embodiments are purely illustrative of the principles and applications of the present invention. It should therefore be understood that numerous modifications could be applied to those illustrative embodiments, and that other embodiments could be envisaged without going beyond the spirit and the ambit of the present invention, as defined by the accompanying claims.

The expression "comprising a" should be understood as being synonymous with "comprising at least one", unless specified to the contrary.

The invention claimed is:

1. A closure cap comprising:

a base portion that includes at least one dispenser orifice, and that is configured to be fastened onto a receptacle body;

a lid that pivots relative to the base portion; and an opening control element configured to control opening of the lid;

wherein the opening control element comprises a skirt that surrounds at least a portion of the base portion, the opening control element being connected to the base portion via at least two elastically-deformable connection elements.

2. The closure cap according to claim 1, wherein the at least two elastically-deformable connection elements are connected at one end to the skirt, and at another end to a portion of the base portion configured to mount the base portion on a neck of the receptacle body.

3. The closure cap according to claim 1, wherein at least one of the at least two elastically-deformable connection elements comprises an arm including a shape that is not rectilinear.

4. The closure cap according to claim 3, wherein the non-rectilinear shape comprises an undulating shape.

5. The closure cap according to claim 1, wherein the at least two elastically-deformable connection elements are connected to the skirt of the opening control element at locations that are situated substantially opposite each other in a plane that is substantially parallel to a pivot axis of the lid.

6. The closure cap according to claim 1, wherein the at least two elastically-deformable connection elements are connected to the base portion at locations that are substantially opposite each other in a plane that is substantially parallel to a pivot axis of the lid.

7. The closure cap according to claim 1, wherein at least one of the at least two elastically-deformable connection elements comes into contact with the base portion, while being in sliding contact therewith, when a user presses on the opening control element.

8. The closure cap according to claim 7, wherein the at least two elastically-deformable connection elements comprise a plurality of deformable connection elements, each of which is connected at two opposite ends to respective portions of the opening control element.

9. The closure cap according to claim 8, wherein a pair of the deformable connection elements comprises two curved portions including concave sides that face each other, the curved portions being configured to be engaged on the base portion when the opening control element is at rest.

10. The closure cap according to claim 1, wherein the skirt includes, on a face on which a user presses, an extension that extends downward away from the lid, the extension being configured to be engaged in a correspondingly-shaped recess of the receptacle body.

11. The closure cap according to claim 1, wherein the opening control element includes at least one portion in relief that is arranged to co-operate with the receptacle body in such a manner that the receptacle body guides displacement of the opening control element, at least in part, while the opening control element is being actuated by a user.

12. The closure cap according to claim 1, wherein the skirt of the opening control element is extended at a top portion thereof by an inwardly-directed rim.

13. The closure cap according to claim 12, wherein at least one of the at least two elastically-deformable connection elements is connected at an end thereof to the rim.

14. The closure cap according to claim 12, wherein the base portion includes a plate that comes to cover the rim, at least in part, when the closure cap is in place on the receptacle body.

15. The closure cap according to claim 1, further comprising a hinge connecting together the lid and the base portion and including at least one spring-forming tongue that assists an opening movement of the lid.

16. The closure cap according to claim 15, wherein the opening control element is configured to act on the spring-forming tongue, when actuated by a user.

17. The closure cap according to claim 1, wherein the opening control element is configured to act directly on the lid, when actuated by a user.

18. The closure cap according to claim 1, wherein the opening control element is configured to act on a portion in relief that is carried by the lid in a region of the lid that is situated substantially remote from a hinge of the lid.

19. The closure cap according to claim 18, wherein the lid includes a tooth on a bottom face thereof in a proximity of an edge of the lid remote from the hinge, and the base portion includes an opening that enables the tooth to co-operate with the opening control element when a user presses on the opening control element, so as to displace the opening control element toward the hinge.

20. The closure cap according to claim 19, wherein a rim of the opening control element includes a notch in which the tooth of the lid is engaged, and a bottom wall of the notch that comes to bear against a sloping face of the tooth when the opening control element is first displaced, so as to cause the lid to start pivoting.

21. The closure cap according to claim 1, wherein the opening control element includes, on a pivoting side, a tab for pressing on a spring-forming tongue, so as to urge the lid to pivot.

22. The closure cap according to claim 21, wherein the tab includes a bracket shape, so as to make it possible to press on the spring-forming tongue at a location that is higher than a pivot axis of the lid.

23. A receptacle comprising:

a body; and a closure fastened onto the body, the closure cap comprising:

a base portion that includes at least one dispenser orifice, and that is fastened onto the receptacle body;

a lid that pivots relative to the base portion; and an opening control element configured to control opening of the lid, wherein the opening control element comprises a skirt that surrounds at least a portion of the base portion, the opening control element being connected to the base portion via at least two elastically-deformable connection elements.

24. The receptacle according to claim 23, wherein a top wall of the receptacle body includes a shoulder shape that defines at least one guide surface along which the opening control element is displaceable.

25. The receptacle according to claim 24, wherein the receptacle body includes, in cross-section, an oblong shape that is elongate along a major axis, the guide surface being formed on either side of a neck of the receptacle body, and being oriented in a direction that is substantially perpendicular to the major axis.

26. The receptacle according to claim 23, the base portion including at least one portion in relief configured to be snap-fastened on a corresponding portion in relief formed on a neck of the receptacle body.

27. The closure cap according to claim 1, wherein the opening control element is not monolithic with the base portion.

28. The closure cap according to claim 1, wherein the opening control element is configured in such a manner to be capable of being displaced through a non-zero stroke before acting on the lid, so as to make it possible for an edge of the lid remote from a hinge to project in front of a face of the skirt on which a user presses, when the opening control element starts to act on the lid.

29. The closure cap according to claim 1, wherein the dispenser orifice is defined by an annular surface that is extended downward away from the lid by at least one elastically-deformable tab that is configured to snap-fasten on a closure pin carried by the lid.

30. The closure cap according to claim 29, wherein the annular surface is extended by a plurality of tabs that are configured to snap-fasten on the closure pin other than on a side remote from a face of the control element on which a user presses to cause the lid to open.

31. A method of manufacturing a receptacle, the method comprising:

molding a closure cap comprising:

a base portion that includes at least one dispenser orifice, and that is configured to be fastened onto a receptacle body;

a lid that pivots relative to the base portion; and an opening control element configured to control opening of the lid;

wherein the opening control element comprises a skirt that surrounds at least a portion of the base portion, the opening control element being connected to the base portion via at least two elastically-deformable connection elements, the base portion including a plate through which the at least one dispenser orifice passes, the plate being molded with a non-zero gap between the skirt and the plate, placing the closure cap on the receptacle body, and exerting pressure on the base portion so as to fasten said base portion on the receptacle body, the at least two elastically-deformable connection elements deforming while the base portion is being fastened onto the receptacle body, and the plate moving closer to the skirt of the opening control element.

32. A method of manufacturing an article comprising a closure cap and a second part, the closure cap including: a base portion that includes at least one dispenser orifice, and that is configured to be fastened onto a receptacle body; a lid that pivots relative to the base portion; and an opening control element configured to control opening of the lid, wherein the opening control element comprises a skirt that surrounds at least a portion of the base portion, the opening control element being connected to the base portion via at least two elastically-deformable connection elements, the method comprising:

molding the closure cap and the second part in a single mold that is provided with at least one extraction pusher, the second part being disposed in the mold relative to the closure cap; and during unmolding, displacing the extraction pusher such that the second part is displaced relative to the closure cap, and the closure cap and the second part are fastened together.

33. The method according to claim 32, wherein the closure cap and the second part are fastened together by snap-fastening.

34. The method according to claim 32, wherein the second part is defined by an opening control element.

35. The closure cap according to claim 7, wherein at least one of the at least two elastically-deformable connection elements is connected at an end thereof to an inwardly-directed rim of the skirt of the control element.

36. The closure cap according to claim 14, wherein the lid includes a tooth on a bottom face thereof in a proximity of an edge of the lid remote from the hinge, and wherein the base portion includes an opening that enables the tooth to co-operate with the opening control element when a user presses on the opening control element, so as to displace the opening control element toward the hinge.

* * * * *